US011174126B2

(12) United States Patent
Dold

(10) Patent No.: US 11,174,126 B2
(45) Date of Patent: Nov. 16, 2021

(54) CONNECTION ELEMENT FOR ELECTRICALLY CONTACTING TENSION MEMBERS IN A LOAD-BEARING BELT FOR AN ELEVATOR SYSTEM, AND METHOD FOR ASSEMBLING THE CONNECTION ELEMENT ON THE BELT

(71) Applicant: Inventio AG, Hergiswil (CH)

(72) Inventor: Florian Dold, Bremgarten (CH)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 16/754,785

(22) PCT Filed: Nov. 27, 2018

(86) PCT No.: PCT/EP2018/082642
§ 371 (c)(1),
(2) Date: Apr. 9, 2020

(87) PCT Pub. No.: WO2019/105910
PCT Pub. Date: Jun. 6, 2019

(65) Prior Publication Data

US 2021/0198083 A1 Jul. 1, 2021

(30) Foreign Application Priority Data

Nov. 28, 2017 (EP) ..... 17203981

(51) Int. Cl.
*B66B 7/08* (2006.01)
*H01R 4/2406* (2018.01)
(Continued)

(52) U.S. Cl.
CPC ..... *B66B 7/085* (2013.01); *B66B 7/1223* (2013.01); *H01R 4/2406* (2018.01); *H01R 4/2433* (2013.01); *H01R 13/422* (2013.01)

(58) Field of Classification Search
None
See application file for complete search history.

(56) References Cited

U.S. PATENT DOCUMENTS 5,554,053 A * 9/1996 Matthews ..... H01R 13/58 439/719
5,947,760 A 9/1999 Gemperli
(Continued)

FOREIGN PATENT DOCUMENTS

CN 104134873 B 11/2014
EP 2463962 A2 6/2012
(Continued)

*Primary Examiner* — Ross N Gushi
(74) *Attorney, Agent, or Firm* — William J. Clemens; Shumaker, Loop & Kendrick, LLP

(57) ABSTRACT

A connection element for electrically contacting tension members embedded into a matrix material of a load-bearing belt for an elevator system has a frame with an upper part, a lower part and multiple electrically conductive contact elements. The frame is shaped to receive the belt in an interior space delimited at at least two opposite sides. The contact elements are formed as stamped and bent metal parts, and some regions of the contact elements are arranged in the upper part of the frame with other regions protruding from the upper part of the frame into the interior space, for example in the form of piercing tips, in order to contact the tension members embedded in the portion of the belt received in the interior space.

18 Claims, 9 Drawing Sheets

(51) Int. Cl.

| | |
|---|---|
| ***B66B 7/12*** | (2006.01) |
| ***H01R 4/2433*** | (2018.01) |
| ***H01R 13/422*** | (2006.01) |

(56) References Cited

U.S. PATENT DOCUMENTS

| | | | | |
|---|---|---|---|---|
| 7,410,033 | B2 * | 8/2008 | Veronesi | B66B 7/062 187/391 |
| 7,819,690 | B2 * | 10/2010 | Faulkner | H01R 12/675 439/397 |
| 2004/0235335 | A1 * | 11/2004 | Schoeffel | H01R 12/675 439/410 |
| 2008/0200077 | A1 | 8/2008 | Faulkner et al. | |
| 2015/0291394 | A1 | 10/2015 | Dold et al. | |
| 2016/0285190 | A1 | 9/2016 | Guo et al. | |

FOREIGN PATENT DOCUMENTS

| | | | |
|---|---|---|---|
| EP | 3124420 | A1 | 2/2017 |
| EP | 3124425 | A1 | 2/2017 |
| EP | 3124986 | A1 | 2/2017 |
| EP | 3309105 | A1 | 4/2018 |
| EP | 3326954 | A1 | 5/2018 |
| WO | 2017021263 | A1 | 2/2017 |
| WO | 2017137282 | A1 | 8/2017 |
| WO | 2017137307 | A1 | 8/2017 |
| WO | 2018141422 | A1 | 8/2018 |
| WO | 2018141553 | A1 | 8/2018 |
| WO | 2018141554 | A1 | 8/2018 |
| WO | 2018234008 | A1 | 12/2018 |

* cited by examiner a)

b)

a)

b)

CONNECTION ELEMENT FOR ELECTRICALLY CONTACTING TENSION MEMBERS IN A LOAD-BEARING BELT FOR AN ELEVATOR SYSTEM, AND METHOD FOR ASSEMBLING THE CONNECTION ELEMENT ON THE BELT

FIELD

The present invention relates to a connection element, by means of which tension members, which are embedded in a load-bearing belt for an elevator system, can be electrically contacted. Furthermore, the invention relates to a belt arrangement for an elevator system and a method for assembling a connection element on a load-bearing belt of an elevator system.

BACKGROUND

In modern elevator systems, elevator cars are moved vertically through an elevator shaft by means of belts driven by a drive unit. The belts generally comprise a plurality of tension members, which are sometimes also called cords, and which mainly effect a load-bearing capacity of the belt. Metal wires, metal braids or metal strands are usually used as tension members. The tension members are generally embedded running parallel to one another in a matrix material in order to effect protection of the cables, for example, against abrasion and/or corrosion, and to be able to increase friction between the belt and, for example, a traction sheave of the drive unit. The matrix material can be a flexible material, for example, a plastics material, particularly a polymer.

Since the belts hold the elevator car, their integrity must always be ensured. Methods have been developed to monitor the integrity of belts of an elevator system by electrically contacting the electrically conductive tension members integrated in the belts from the outside. Electrical properties of the tension members thus contacted can then be monitored, for example, in order to be able to determine changes in the belt, particularly with regard to its load-bearing capacity, due to changes in these electrical properties occurring over time. Various embodiments of such an approach for monitoring the integrity of belts in an elevator system are described, for example, in WO 2017/021263 A1. Further details on embodiments of monitoring methods and devices and components that can be used therefor are explained in a number of earlier applications by the applicant of the present patent application, for example EP 17177132, PCT/EP2017/065253, EP 17166943, EP 17166927, PCT/EP2017/052281, PCT/EP2017/052064, EP 16193877, EP 16200551, EP 16165431, EP 16155358, and EP 16155357. The contents of these earlier applications are intended to be incorporated by reference in their entirety.

In order to be able to suitably contact the tension members within the belt electrically, different methods, connection elements and/or tools have been developed.

Among other things, there may be a need for a connection element, by means of which an electrical contact between an external circuit and tension members can be established in a belt of an elevator system in a reliable and/or simple manner. In particular, there may be a need for a connection element that can be easily and/or inexpensively manufactured and/or assembled on a belt. Furthermore, there may be a need for a belt arrangement for an elevator system in which such a connection element is attached to a belt. In addition, there may be a need for a method by means of which a connection element can be assembled on a belt of an elevator system in an advantageous manner, in particular in a simple, reliable and/or inexpensive manner.

SUMMARY

Such a need can be met by the connection element, the belt arrangement, and the method according to embodiments defined in the following description.

According to a first aspect of the invention, a connection element for the electrical contacting of tension members, which are embedded in a load-bearing belt for an elevator system in a matrix material, is proposed. According to a first embodiment, the connection element has an at least two-part frame with an upper part and a lower part and a plurality of electrically conductive contact elements. The shape of the frame is designed to receive the belt in an interior space delimited by the frame on at least two opposite sides. The contact elements are designed as stamped and bent metal parts. The contact elements are received in some regions in the upper part of the frame and protrude in some regions from the upper part of the frame into the interior.

Optionally, in a simplified embodiment, the connection element for the electrical contacting of tension members, which are embedded in a load-bearing belt for an elevator system in a matrix material, can only have a frame consisting of the upper part. The shape of the upper part forming the frame is designed to receive the belt in an interior delimited by the frame on at least two opposite sides. The contact elements are designed as stamped and bent metal parts. The contact elements are received in some regions in the upper part of the frame and protrude in some regions from the upper part of the frame into the interior. Even if this simplified embodiment is not explained separately in detail below and is executed separately, the corresponding features and advantages achieved in the first embodiment can be applied analogously to the simplified embodiment. In particular, all designs for the contact elements and the associated electrical contacting are also valid for the simplified embodiment. The only difference is the non-existent lower part of the frame.

According to a second aspect of the invention, a belt arrangement for an elevator system is proposed, which has a load-bearing belt and a connection element according to the embodiments of the first aspect of the invention. The belt has a plurality of electrically conductive tension members which are embedded in an electrically insulating matrix material and which are arranged at a distance from one another in an arrangement direction. The belt is arranged in the interior of the frame of the connection element, and regions of contact elements of the connection element protruding into the interior each contact one of the tension members of the belt. According to a third aspect of the invention, a method for assembling a connection element according to the embodiments of the first aspect of the invention on a load-bearing belt for an elevator system is proposed. The method comprises the following steps: the upper part of the frame of the connection element is arranged on a first surface of the belt and the lower part of the frame of the connection element is arranged on a second surface of the belt opposite the first surface. Subsequently, the upper part and the lower part of the frame are pressed together in such a way that the regions of the contact elements protruding from the upper part into the interior are pressed into the belt and contact the embedded tension members there.

In a preferred embodiment of the method for assembling a connection element as described above and below on a load-bearing belt for an elevator system, this comprises the following steps: arranging at least the upper part of the frame of the connection element on a first surface of the belt. Arranging a counterpart to the upper part of the frame of the connection element on a second surface of the belt opposite the first surface. Pressing the upper part and the counterpart of the frame together in such a way that the regions of the contact elements protruding from the upper part into the interior are pressed into the belt and contact the embedded tension members there.

In this case, since the lower part is not present in the simplified embodiment, there is no need to arrange the separate lower part on the second surface of the belt opposite the first surface. The upper part is simply pressed onto the belt and held on the belt due to the contact elements pressed into the belt. Optionally, securing means can be provided, such as, for example, clips or corresponding projections on the upper part that at least partially engage behind the belt.

In a preferred embodiment for assembling the simplified embodiment of the connection element, the counterpart is not part of the connection element itself, but is rather designed as a separate element that is different from the connection element. The counterpart can be designed as a flat counter surface or as a counterpart having a profile that is inverse to the profile of the belt.

In a preferred embodiment of the method for assembling the simplified embodiment of the connection element, the counterpart is designed as part of a pair of pliers specially provided for this purpose, in particular parallel pliers, and has cutouts for receiving the profiling of the belt, in particular the V-shaped ribs of the belt. The upper part of the connection element is pressed into the belt using this part of the pliers, which functions as a counterpart. After the pressing process, the pliers are removed, which also means that the counterpart is removed from the belt.

In a preferred embodiment of the method for assembling the non-simplified embodiment, the method is substantially identical to the method described above, with the exception that the counterpart is formed by the lower part of the non-simplified connection element as described above. In a preferred embodiment, the method therefore comprises the following steps:

arranging the upper part of the frame of the connection element on a first surface of the belt and the lower part of the frame of the connection element on a second surface of the belt opposite the first surface. Pressing the upper part and the lower part of the frame together in such a way that the regions of the contact elements protruding from the upper part into the interior are pressed into the belt and contact the embedded tension members there. In a preferred embodiment of this method, the upper part and the lower part of the connection element are pressed together using parallel pliers.

Possible features and advantages of embodiments of the invention may be considered, inter alia, and without limiting the invention, as being based on the ideas and findings described below.

The connection element described here is intended to make electrical contact with a plurality of tension members received in a load-bearing belt of an elevator system, in order to be able to electrically connect the tension members to the outside to form an external circuit and/or to connect said tension members to one another. The external circuit can be part of a monitoring device, for example, by means of which electrical voltages can be applied to tension members of belts which are electrically contacted with the aid of connection elements, in order to be able to analyze their electrical properties and in particular to be able to detect changes in these electrical properties.

In order on the one hand to be able to produce the desired electrical contact to the tension members in a simple and/or reliable manner and on the other hand to be able to produce the connection element used for this in a simple, inexpensive, and/or robust manner, it was recognized as advantageous that the connection element on the one hand had an at least two-part frame and on the other hand had a plurality of electrically conductive contact elements which are simple and robust to manufacture.

The frame should have an upper part and a lower part, which can be mechanically connected, i.e. coupled, in a simple manner when the connection element is being assembled. The upper part and the lower part should be designed and cooperate with one another in such a way that a belt to be contacted is received in the interior between the upper part and the lower part in the assembled state. The frame formed with the upper part and the lower part can enclose the belt preferably in a ring, i.e. from an upper side and an opposite lower side and from two opposite flanks connecting the upper side and the lower side. In the assembled state of the frame, the upper part and the lower part can be mechanically interconnected via one or more webs provided on their lateral edges. The upper part and the lower part can preferably be assembled and interconnected in such a way that a surface of the upper part directed towards the belt is directed towards a first of the main surfaces of the belt and abuts as flatly as possible thereon and a surface of the lower part directed towards the belt is directed towards a second of the main surfaces of the belt, which is opposite to the first main surface, and abuts as flatly as possible or at least in regions thereon. The belt is thus received in the assembled state between the upper part and the lower part of the connection element and is preferably clamped in place.

In the simplified embodiment of the connection element, this double-sided clamping of the belt between the lower part and the upper part is omitted. The upper part is simply pressed onto the belt and held on the belt due to the contact elements pressed into the belt. Optionally, securing means can be provided, such as, for example, clips or corresponding projections on the upper part that at least partially engage behind the belt.

The upper part and/or the lower part can both preferably be in one piece. The upper part and/or the lower part can be made of an electrically insulating material, in particular plastics material, or can at least be superficially coated with said material. For example, the upper part and/or the lower part can be injection molded parts that can be produced inexpensively. The upper part and/or the lower part can have a width which substantially corresponds to a width of the belt to be contacted or is greater than said width.

The contact elements of the connection element are designed as inexpensive stamped and bent metal parts. The contact elements can be made in one piece as stamped and bent parts. Stamped and bent parts can easily be made from sheet metal in large quantities by bending and stamping them into suitable shapes. The metal sheets of the stamped and bent parts can, for example, have a thickness of between 0.2 mm and 2 mm, preferably between 0.5 mm and 1 mm.

Each of the contact elements of a connection element can be received with a first region in the upper part of the frame and protrude with a second region away from the upper part of the frame into the interior enclosed by the frame. The first region of the contact element can, for example, be poured into the upper part of the frame, glued in, or otherwise received and fastened therein. For example, the first region of the contact element can extend to a depth of at least 0.5 mm, preferably at least 1 mm, into the upper part of the frame. The contact element is thus mechanically fixed to the frame via its first region.

The second region of the contact element can be pressed into the matrix material of the belt when the connection element is assembled on the belt, i.e. when the belt is received in the interior of the frame of the connection element and pressed onto the upper part of the frame, in order in this way to be able to contact the tension member embedded in the matrix material. A distance up to which the second region of the contact element protrudes from the surface of the upper part into the interior can be greater than or equal to a depth at which the tension members typically run in the matrix material of the belt. For example, such a distance can be at least 0.3 mm, preferably at least 0.5 mm or at least 0.8 mm.

Different contact elements can be provided in one and the same connection element. A shape of the stamped and bent parts can be adapted for different types of contact elements to their respective function to be performed.

For example, according to one embodiment, the contact element can have a central region and at least one piercing tip protruding from the central region and penetrating into the matrix material of the belt.

The central region can be a type of leg or web, which is formed by part of the stamped and bent part. The central region can be elongated and extend transversely to the piercing tip. The central region can at least partially form that region of the contact element which is received in the upper part of the frame, in particular anchored therein. The central region can optionally mechanically connect several piercing tips of the contact element to one another.

The piercing tip extends away from the central region of the contact element into the interior surrounded by the frame. At its cantilevered end, the piercing tip is pointed, that is to say tapered, so that it can penetrate into the matrix material of a belt that is received in this interior and pressed toward the upper part of the frame using relatively little pressure. A radius of curvature can be smaller than a width of the piercing tip.

According to one embodiment, the central region has at least one leg, which runs parallel to a surface of the frame facing the interior, and two piercing tips protrude from the leg into the interior. The piercing tips are in this case spaced apart from one another in a longitudinal direction of the belt to be received by the connection element and offset in a transverse direction running transversely to the longitudinal direction by between 0.1 mm and 1 mm, preferably between 0.3 mm and 0.7 mm.

In other words, the central region can extend as an elongated leg parallel to that surface of the upper part of the frame from which the piercing tip protrudes into the interior. The leg can extend at least in regions parallel to the longitudinal direction of the belt to be received by the connection element, i.e. parallel to the tension members embedded in the belt. The leg can be straight or alternatively provided with one or more curvatures. In this case, two piercing tips extend from the leg and transversely to it into the interior. These piercing tips are arranged at a distance from one another along the leg, i.e. along the longitudinal direction mentioned. A distance can be, for example, a few millimeters, for example between 1 mm and 20 mm, preferably between 2 mm and 10 mm. However, the two piercing tips are not arranged exactly one behind the other in the longitudinal direction mentioned, that is to say in alignment with one another. Instead, the two piercing tips are offset from one another transversely to this longitudinal direction. The spatial offset between the two piercing tips thus extends in a direction transverse to the longitudinal direction of the tension members of the belt to be contacted by the piercing tips.

In a preferred embodiment, the piercing tips are spaced apart in a transverse direction relative to the longitudinal direction by a maximum distance, which depends on the diameter of the tension member. In a preferred embodiment, this maximum distance is proportional to the diameter of the tension member and is approximately 40-70% of the diameter of the tension member. In one embodiment, the tension member diameter is 1.73 mm and the maximum distance is 1 mm, which results in a range for the distance between 0.1 and approximately 1 mm. In a further embodiment, the tension member diameter is 2.7 mm and the maximum distance is 1.56 mm, which results in a range for the distance from 0.1 mm to approximately 1.56 mm. This dependency ensures reliable contacting of the tension members through the piercing tips regardless of the tension member diameter.

Tension members cannot be arranged exactly at the intended positions within the belt, for example due to manufacturing tolerances. Instead, tension members within the belt can, for example, be offset laterally by up to 0.5 mm to such desired positions. Since the contact element has two piercing tips offset in relation to one another in the manner mentioned, the probability that the contact element contacts a tension member in the belt approximately in the center with at least one of the piercing tips can be considerably increased. As a result, the reliability of an electrical contact can be improved.

According to one embodiment, the central region can have two legs running parallel to one another, with at least one piercing tip protruding into the interior of each of the legs.

In other words, the central region can have two legs which run, at least in some regions, parallel to one another. Each of the legs can in turn run parallel to a tension member to be contacted by the contact element in the belt, so that the piercing tip protruding from it can contact the tension member. The two legs can be interconnected by a region of the central region which runs transversely to the legs. The entire central region can thus have a U-shape. At least one piercing tip but preferably at least two piercing tips, arranged in the above-mentioned staggered manner, protrude from each leg away from the leg into the interior or the belt received therein. All piercing tips emanating from both legs can run parallel to each other.

With the aid of the piercing tips emanating from each of the legs, two adjacent tension members or at least two tension members which are spaced apart in the transverse direction in the belt can be contacted. Since the piercing tips are part of one and the same contact element, i.e. since the two legs are mechanically and electrically interconnected, the contact element can thus establish an electrical connection between the contacted tension members. A contact element designed in this way can thus electrically connect different tension members running separately from one another in the belt and interconnect them for example in parallel or in series.

According to one embodiment, the contact element has a connection region for connecting an electrical line.

The connection region should be designed so that an electrical line, for example in the form of a wire, can be connected to the contact element. Such an electrical line can serve to electrically connect the contact element, for example, to an external circuit. Such a circuit can be part of a monitoring circuit, for example. In principle, the connection region can be provided at different positions of the contact element and be structurally designed in different ways.

According to a special embodiment, the connection region can protrude, for example, from the central region in a direction opposite to the piercing tip.

In other words, one or more piercing tips can protrude from the central region of the contact element in one direction and the connection region can protrude in an opposite direction. While the piercing tips protrude into the interior surrounded by the frame, this does not apply to the connection region. An electrical line can be attached to the connection region. The connection region of the contact element together with the electrical line attached thereto, as well as the central region of the contact element, can be integrated into the upper part of the frame.

According to a special embodiment, the connection region can be provided with an insulation displacement terminal.

The insulation displacement terminal can be designed as an integral part of the stamped and bent part forming the contact element. The insulation displacement terminal can be formed with two sharp-edged sheet metal parts, which form a narrow gap between them. An electrical line can be pressed into the gap and then held therein. The electrical line can be, for example, a wire provided with an insulating sheathing, the sheathing being able to be severed when it is pressed into the insulation displacement terminal and an electrical contact between the insulation displacement terminal and the wire can thus be established.

According to one embodiment, the connection element described here can thus additionally have an electrical line, one end of which is connected to the connection region of one of the contact elements and the other end of which is led out of the frame of the connection element for external contacting.

In other words, the connection element can have an electrical line leading to the outside, via which at least one or preferably more of the contact elements provided in the connection element can be connected to an external circuit. For example, two or more electrical lines can be provided in the connection element in order to be able to electrically connect the tension members of a belt contacted by the contact elements, for example to a monitoring circuit and/or to tension members of other belts, in order to be able to apply an electric voltage to them and monitor said voltage, for example.

According to one embodiment, the contact element is made of stainless steel.

In principle, the contact elements can consist of any electrically conductive materials, in particular metals, or can be coated with this. However, the contact elements have to meet high mechanical, electrical and/or chemical requirements. For example, the contact elements should be mechanically strong enough not to deform excessively when pressed into a belt. In addition, the contact elements should have a sufficiently low electrical resistance. Furthermore, the contact elements should react as little as possible with surrounding media, for example to avoid local corrosion. In particular, it was recognized that the contact elements, on the one hand, should contact the tension members in the belt and, on the other hand, if necessary, should contact electrical lines leading to the outside. The tension members are often made with galvanized wires, whereas the electrical lines are often made with copper wires. In the case of combinations of materials which are not suitably selected, in particular if metals which are unsuitable for the contact elements are used, local elements can be formed at the interfaces between a contact element and a tension member contacted by the latter or an electrical line connected thereto. Corrosion may then occur in the region of such local elements. By forming the contact elements from stainless steel, they can meet the various requirements mentioned.

According to one embodiment, the frame has locking elements in order to interlock the upper part and the lower part of the frame.

In other words, suitable precautions can be taken on the upper part and the lower part of the frame in order to be able to interlock, for example, during an assembly process. In this context, locking can be understood to mean that components of a locking element provided on the upper part and the lower part can be brought together in such a way that they interact with one another in a form-fitting manner. The components can usually be easily locked together, in particular without tools, but are difficult to be separated from one another again, in particular only with the aid of tools.

The upper part and the lower part can thus be displaced towards one another and components of the locking elements engage in one another, so that the upper part and the lower part remain firmly interconnected via the locking elements, even after the pressure exerted for displacement on the upper part and the lower part has been released. The locking elements can be formed as an integral part of the frame. For example, a tab can be formed on the upper part, which cooperates with a hook formed on the lower part when assembling the frame, or vice versa.

In order to assemble the connection element on a belt by means of the method presented herein as the second aspect of the invention, according to one embodiment the upper part and the lower part can be pressed together, i.e. towards one another, using parallel pliers.

In other words, the frame of the connection element can thereby be fastened to the belt and the contact elements can be pressed into the belt by pressing the upper part and the lower part towards one another after they have been previously positioned above and below the belt. The upper and lower parts, which previously only loosely rest on the belt, are pressed towards the belt, so that the interior space in between is reduced and the regions of the contact elements protruding into the interior, i.e. in particular the piercing tips, are pressed into the belt and can contact the embedded tension members there.

A special tool in the form of parallel pliers can be used to press the upper part and the lower part together. Such parallel pliers can be understood as a pair of pliers whose jaws do not pivot relative to one another when the pliers are closed, but are moved toward one another in parallel or substantially parallel to one another. Such parallel pliers are intended for various purposes, for example as crimping pliers, and are sometimes also referred to as parallel lifting pliers. Using suitable mechanisms and/or translations, components can be pressed together using parallel pliers by means of very high forces, for example in a range from several hundred Newtons to several tens of Kilonewtons. The parallel pliers can preferably be operated manually. Alternatively, conventional pliers and or another clamping or striking tool can be used for assembly instead of parallel pliers.

When assembling the connection element presented here, the use of parallel pliers can, among other things, achieve that the upper part and the lower part of the frame of the connection element can be pressed parallel to one another and aligned. This can prevent, for example, that the upper part of the frame is pressed obliquely towards the belt and that the piercing tips are pressed into the belt at an oblique angle. Locking of locking elements on the upper and lower part of the frame can also be effected uniformly.

According to one embodiment, the frame can have double locking elements in order to engage the upper part and the lower part of the frame in a pre-locking manner in a first locking position at a distance from a belt received in the interior and in order to engage the upper part and the lower part in an end-locking manner in a second locking position abutting against opposite surfaces of the belt received in the interior.

In other words, the locking elements already mentioned above cannot only be designed to lock the upper part and the lower part together in a finally assembled position. Instead, they can be designed as double locking elements, in which the upper part and the lower part can be interlocked in two different positions.

In the first locking position, the upper part and the lower part are already pre-locked to one another, that is to say mechanically interconnected at least to the extent that they engage with one another even without further external force being exerted. At this stage, however, the upper part and the lower part are not yet displaced so closely towards one another such that both lie closely against the frame to be contacted. Instead, the belt should only be received relatively loosely in the interior of the frame in this pre-locked assembly stage. In particular, in this assembly stage, the regions of the contact elements that protrude into the interior, i.e. for example, the piercing tips, should not yet be pressed into the belt, or at least not significantly. Accordingly, the frame of the connection element is only loosely attached to the belt in this pre-locked state to the extent that it cannot, for example, detach itself from the belt. Relatively small forces, for example in the range from a few Newtons to a few hundred Newtons, in particular forces such as those that can be generated manually by a technician, for example, are sufficient to establish such a pre-locking.

In the second locking position, the upper part and the lower part have then been pressed towards their finally assembled position, that is to say into a configuration in which the upper part is placed on an upper side of the belt to be contacted and the regions of the contact elements protruding into the interior are pressed deep into the belt and contact the tension members there. In this configuration, the lower part rests on an opposite underside of the belt. In this end-locking state, the upper part and the lower part thus clamp the belt held between them, wherein the double locking elements are able to absorb the forces that may be acting on the frame. In order to establish such an end locking and to press the piercing tips, for example, into the belt, manual forces are usually not sufficient. Instead, high forces may be required to press the upper part toward the lower part of the frame into the end-locked position, in particular in the range of more than 500 N or even several kN, as can be achieved, for example, using pliers, in particular parallel pliers, or other tools.

According to one embodiment, the frame can have screwing elements in order to screw the upper part and the lower part of the frame together.

The screwing elements can have screws and possibly associated nuts and/or washers or the like. The screwing elements can in particular serve to mechanically connect the upper part and the lower part of the frame to one another in a state assembled on the belt, for example to prevent them from becoming detached from one another over time. The screwing elements can optionally be provided in addition to locking elements. In this case, the screwing elements can be screwed after the locking elements have been locked in a finally assembled state in order to additionally secure this state.

If, as in the simplified embodiment of the connection element, the lower part is missing, the upper part can be pressed directly onto the belt using the tools described, in particular the parallel pliers described. In other words, the belt can be pressed directly into the interior enclosed by the upper part using the tools described. Optionally, the tool part, which acts directly on the belt instead of the lower part, can be specially designed to receive the belt for the pressing process and to correctly position it with respect to the upper part.

It is pointed out that some of the possible features and advantages of the invention are described herein with reference to different embodiments of a connection element according to the invention on the one hand and a method for assembling such a connection element on a belt or a belt arrangement formed thereby. A person skilled in the art recognizes that the features can be combined, transferred, adapted, or replaced in a suitable manner in order to arrive at further embodiments of the invention.

Embodiments of the invention will be described in the following with reference to the accompanying drawings, although neither the drawings nor the description should be construed as limiting the invention.

The figures are merely schematic and not true to scale. Like reference signs refer to like or equivalent features in the various drawings

DETAILED DESCRIPTION

Figure 1:
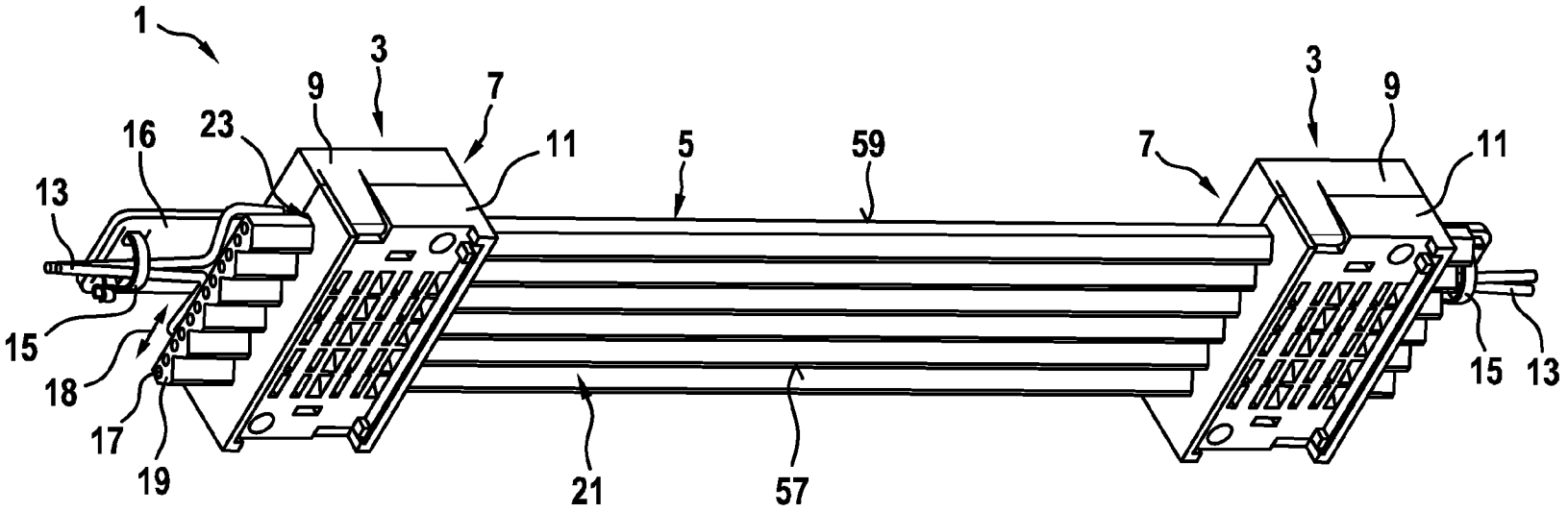
FIG. 1 shows a perspective view of a belt arrangement having two connection elements according to one embodiment of the present invention.

FIG. 1 shows a belt arrangement 1 according to the invention for an elevator system. The belt arrangement 1 has a load-bearing belt 5, to which a connection element 3 is attached in the region of opposite ends of the belt 5.

The load-bearing belt 5 comprises a plurality of tension members 17 which run parallel to one another and to a longitudinal direction of the belt 5 and which are at a distance from one another in an arrangement direction 18. The tension members 17 are embedded in a polymer-like matrix material 19. The contour of the belt 5 formed by the matrix material 19 has a profile 21 on a lower side 57, which is directed downward in the figure, having V-shaped ribs running in the longitudinal direction or grooves arranged between the ribs, whereas an opposite upper side 59 is flat.

The connection elements 3 serve to make electrical contact with the tension members 17 received in the belt 5. Each connection element 3 has a frame 7 made of plastics material, which is composed in two parts from an upper part 9 and a lower part 11. The upper part 9 and the lower part 11 each abut the top 59 and the bottom 57 of the belt 5 respectively. Thus, the frame 7 forms an interior space 23 between the upper part 9 and the lower part 11, through which the belt 5 runs, so that the belt 5 is enclosed by the frame 7.

On the upper part 9, electrical lines 13 are provided which come out of the upper part 9 and which can serve to connect the respective connection element 3 electrically, for example to an external circuit, in particular to an external monitoring device. In the example shown, the upper part 9 has an extension 16 on which the electrical lines 13 can be held to form a tension relief 15, for example with the aid of a cable tie, a tension relief clamp, or a cable grommet.

Figure 2:
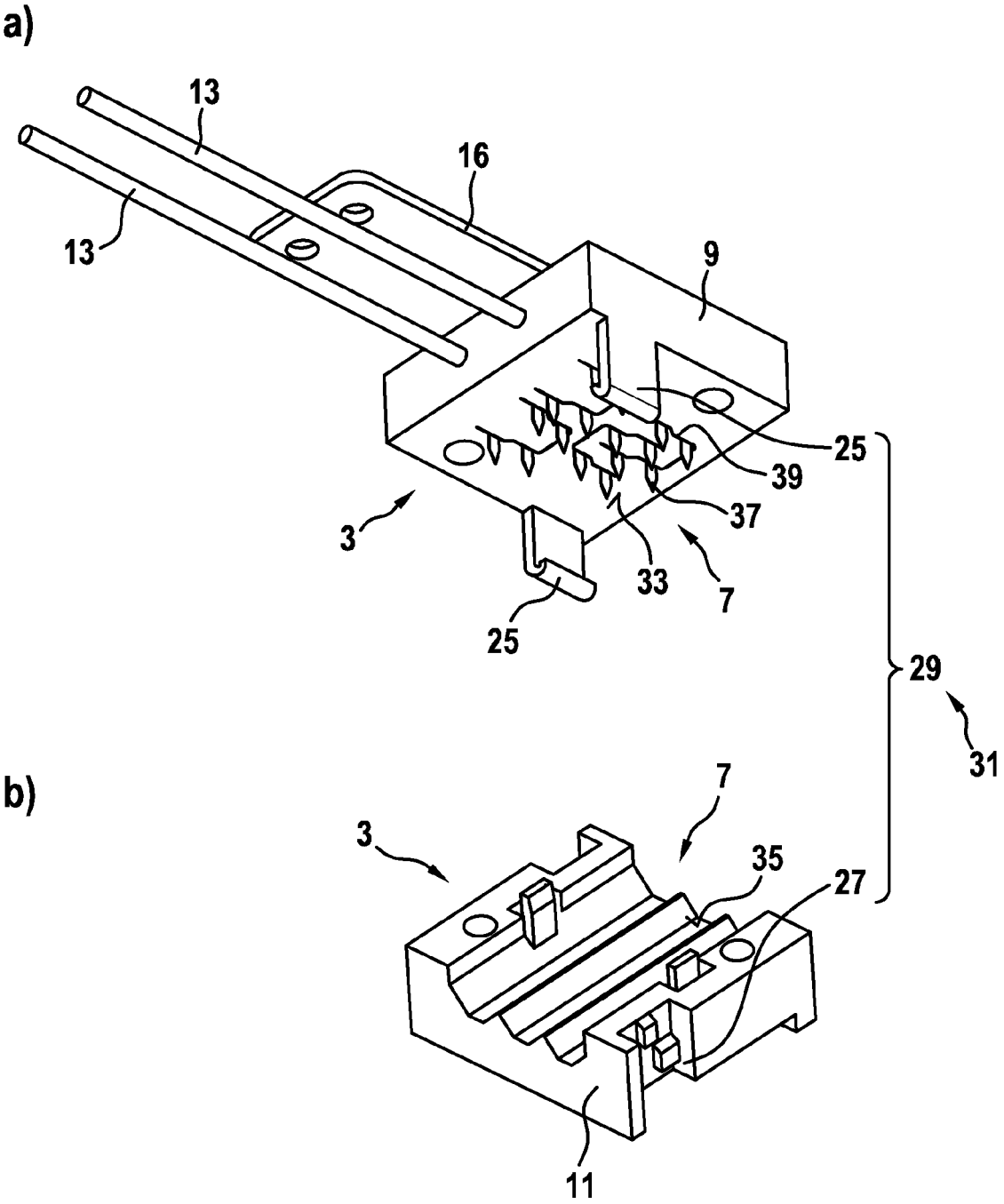
FIGS. 2(*a*) and (*b*) each show a perspective view of an upper part and a lower part of a connection element according to an embodiment of the present invention.

FIGS. 2(*a*) and (*b*) show an upper part 9 and a lower part 11 of a frame 7 of a connection element 3 in a separate view. The upper part 9 has a flat inner surface 33 on its side facing the belt 5, so that this inner surface 33 can lie flat against the likewise flat upper side 59 of the belt 5. The lower part 11 has, on the side thereof facing the belt 5, a profiled inner surface 35, which corresponds in terms of its contour to the profile 21 of the belt 5 and can therefore lie flat on the underside 57 thereof.

A plurality of piercing tips 37 protrude downward from the inner surface 33 of the upper part 9, i.e. towards the interior 23 to be enclosed by the frame 7. These piercing tips 37 are part of contact elements 39 which are partially received in the upper part 9 and which partially protrude away from the upper part 9 in the form of the piercing tips 37.

Furthermore, two locking elements 31 are formed on the frame 7 on opposite lateral edges of the frame 7. Each of the locking elements 31 has a locking tab 25 which, in the example shown, is attached to the upper part 9 and is integrally formed therewith, and a locking counterpart 27 which is provided on the lower part 11 of the frame 7 and is integrally formed therewith. The locking elements 31 serve to mechanically fix the upper part 9 with the lower part 11 in a state assembled on the belt 5. In the example shown, the locking elements 31 are designed as double locking elements 29, the function of which will be described below.

At this point and with reference to FIG. 2(*a*), reference should again be made to the above-mentioned, simplified embodiment of the connection element, in which the belt is contacted only by means of an upper part. In order to be able to position the upper part precisely with respect to the belt, protruding positioning elements can optionally be provided instead of the locking tabs 25 shown. These can extend along the entire length of the top part to ensure maximum lateral guidance.

Optionally, these positioning elements can each be formed at the free ends having a projection directed towards the interior, which engages behind the belt when the belt is fully pressed in. In the case of the profiled belt, these projections can run at least partially along the outermost oblique flank and thus give the belt additional support when pressed in. These positioning elements are discussed in more detail in the description of FIG. 11 below.

Figure 3:
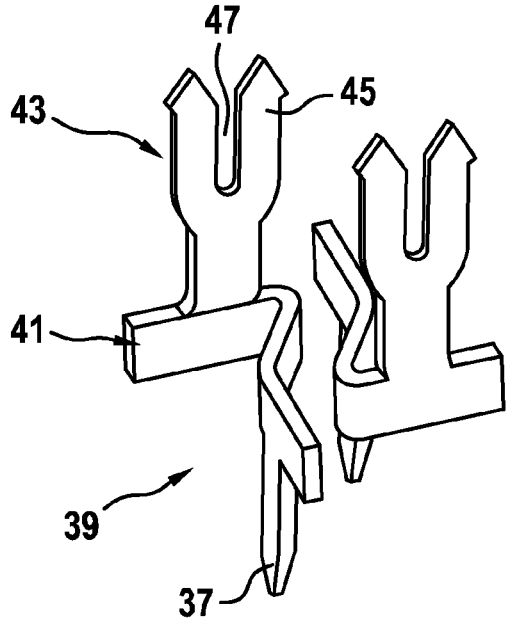
FIGS. 3(*a*) and (*b*) each show a perspective view of contact elements of a connection element according to an embodiment of the present invention.
Figure 3:
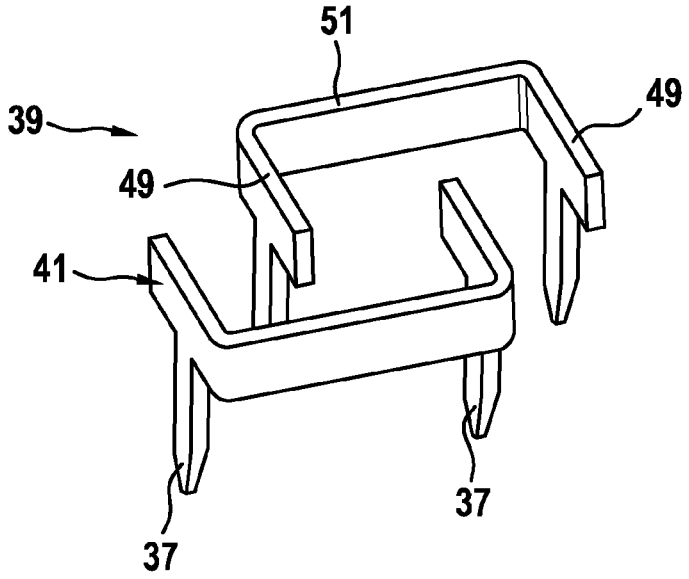

FIGS. 3(*a*) and (*b*) show different types of contact elements 39. Each of the contact elements 39 is designed as a stamped and bent part, that is to say was produced from a metal sheet by suitable stamping out and bending.

The contact elements 39 have a central region 41 in the form of a leg 49 which runs horizontally in the figure shown, and also have piercing tips 37 which project away from this central region 41 and which run vertically in the figure shown. The central region 41 may connect several of the piercing tips 37 provided on a contact element 39 to one another both mechanically and electrically.

The contact elements 39 shown in FIG. 3(*a*) furthermore have a connection region 43, which protrudes in the form of an insulation displacement terminal 45 from the central region 41 in the opposite direction relative to the piercing tips 37. The insulation displacement terminal 45 is formed having two sheet metal regions slightly spaced apart from one another, between which a gap 47 remains. For example, a wire of the electrical lines 13 insulated with a sheathing can be pressed into the gap 47, and the sheathing can be locally stripped.

Figure 4:
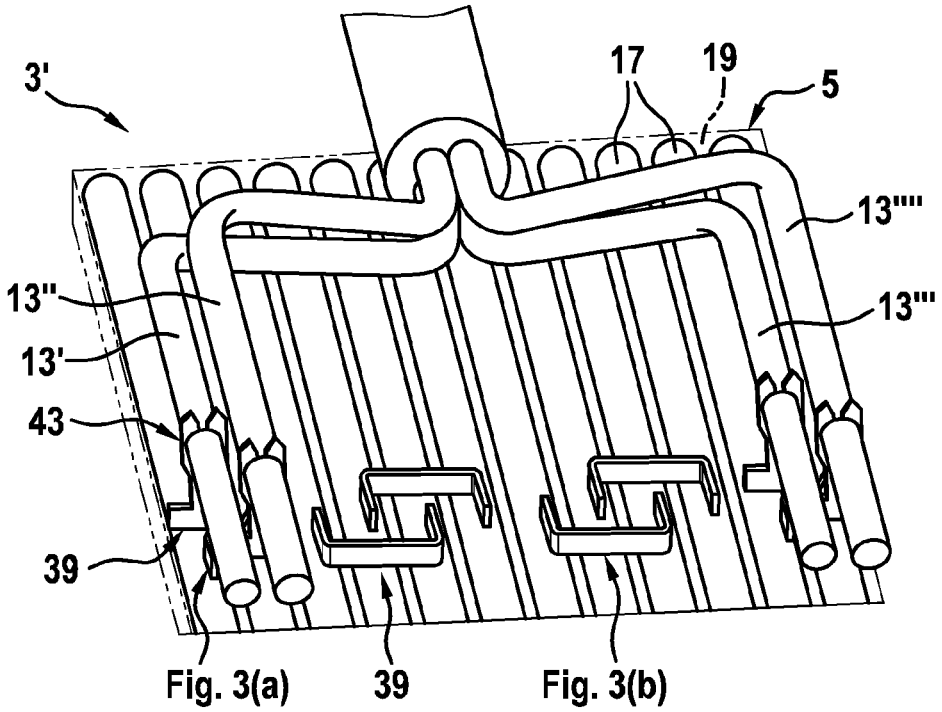
FIG. 4 shows a perspective view of an arrangement of contact elements in an upper part of a measuring connection element according to an embodiment of the present invention.
Figure 5:
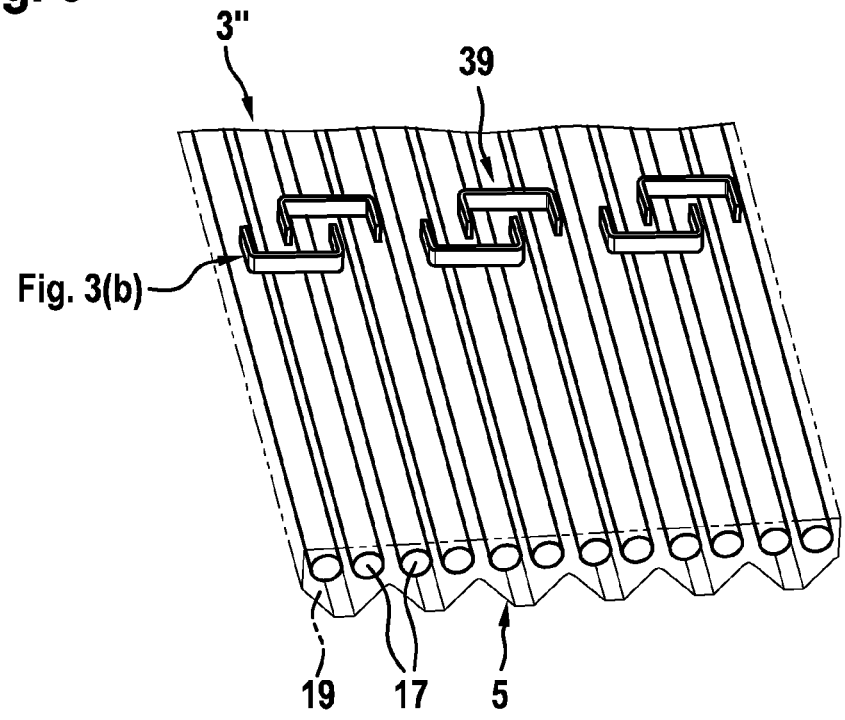
FIG. 5 shows a perspective view of an arrangement of contact elements in an upper part of a bridging connection element according to an embodiment of the present invention.

FIG. 4 shows an arrangement of contact elements 39 in an upper part 9 of a measuring connection element 3'. FIG. 5 shows an arrangement of contact elements 39 in an upper part 9 of a bridging connection element 3". Since it is only intended to illustrate how the contact elements 39 are arranged in the respective upper part 9 and are oriented relative to the belt 5 and the tension members 17 embedded therein, the upper part 9 has not been shown for reasons of clarity.

In the example shown, the measuring connection element 3' from FIG. 4 serves to electrically connect at least some of the tension members 17 in the belt 5, for example to a monitoring device (not shown), via electrical lines 13 leading to the outside. For this purpose, two contact elements 39 are provided adjacent to the two lateral edges of the belt 5 in the measuring connection element 3', which have a connection region 43, in the insulation displacement terminal 45 of which one end of one of the electrical lines 13', 13", 13''', 13'''' was clamped. The piercing tips 37 of these contact elements 39 are pressed into the adjacent tension members 17. Thus, the first and second tension members 17 and the penultimate and last tension members 17 of the belt are each electrically connected to one of the lines 13', 13", 13''', 13''''. Furthermore, in the measuring connection element 3', some of the tension members 17 in the belt 5 are each electrically connected to adjacent tension members 17 by means of further contact elements 39. In other words, contact elements 39 electrically interconnect odd-numbered adjacent tension members 17 or even-numbered adjacent tension members 17.

The bridging connection element 3' from FIG. 5 also has contact elements 39, by means of which some of the tension members 17 in the belt 5 are each electrically connected to adjacent tension members 17. The arrangement of the contact elements 39 in the bridging connection element 3" is complementary to that in the measuring connection element 3'.

Accordingly, with the measuring connection element 3' and the bridging connection element 3", all odd-numbered tension members 17 in the belt 5 can be interconnected in series and a voltage, in particular a first AC voltage, generated by the monitoring device can be applied to this series connection via two of the electrical lines 13', 3'''. Furthermore, all even-numbered tension members 17 in the belt 5 can also be interconnected in series and a further voltage, in particular a second AC voltage which is phase-shifted by 180° relative to the first AC voltage, generated by the monitoring device can be applied to this series connection via two other of the electrical lines 13", 3''''. By monitoring the voltages applied to the tension members 17 of the belt 5, it is then possible to draw conclusions as to their electrical properties and thereby the mechanical properties of the belt 5.

It is pointed out that the connection elements 3, 3', 3" shown and discussed here and in particular the electrical contacting or interconnection of tension members 17 in the belt 5 to be achieved therewith are only intended as examples. In addition to the illustrated and discussed circuits, that is, for example, the series connection of odd-numbered or even-numbered tension members 17 of a belt 5 described above, there are various other options for interconnecting tension members 17 within a belt 5 or also tension members 17 of a belt 5 with tension members 17 of another belt 5. For example, some or all of the tension members 17 provided in one or more belts 5 can be interconnected in series or interconnected in parallel. For this purpose, different configurations of contact elements 39 can be provided, each of which can be provided as stamped and bent parts having a correspondingly suitable geometry, or a plurality of contact elements 39 can be received in a suitable manner arranged relative to one another in a connection element 3.

Figure 6:
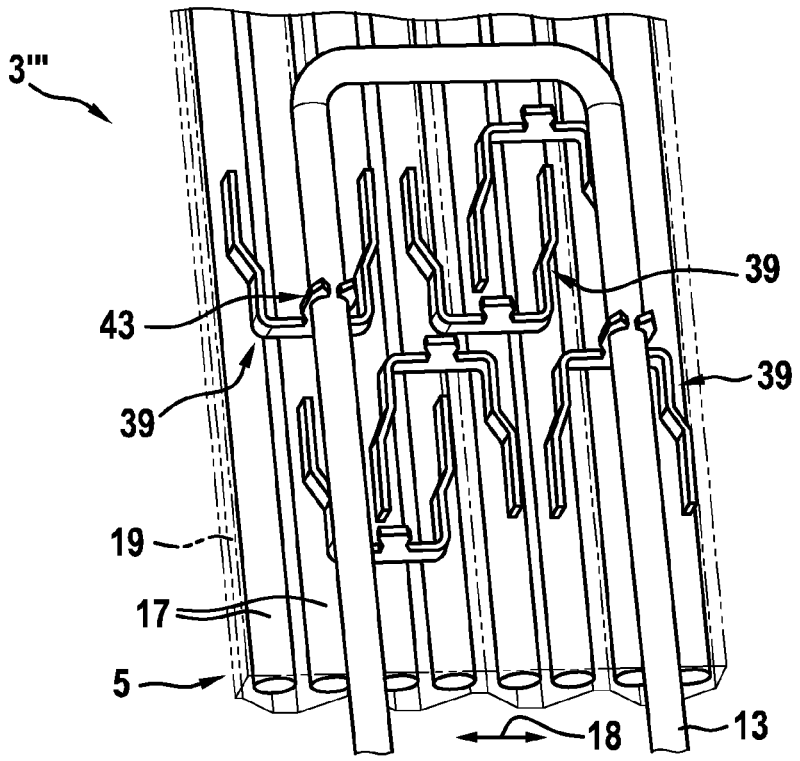
FIG. 6 shows a perspective view of an arrangement of contact elements in an upper part of a measuring connection element according to an alternative embodiment of the present invention.

For example, FIG. 6 shows an embodiment of a circuit implemented by a parallel connection element 3''', in which all eight tension members 17 are interconnected in parallel within a belt 5 and are connected to an electrical line 13 by means of six contact elements 39.

In the embodiment shown in FIG. 6, specially designed contact elements 39 are used. Similar to the configurations shown in FIGS. 3 to 5, each contact element 39 has an essentially U-shaped shape in plan view, i.e. the central region 41 comprises two legs 49, which are interconnected by a transverse web 51 running therebetween.

Figure 7:
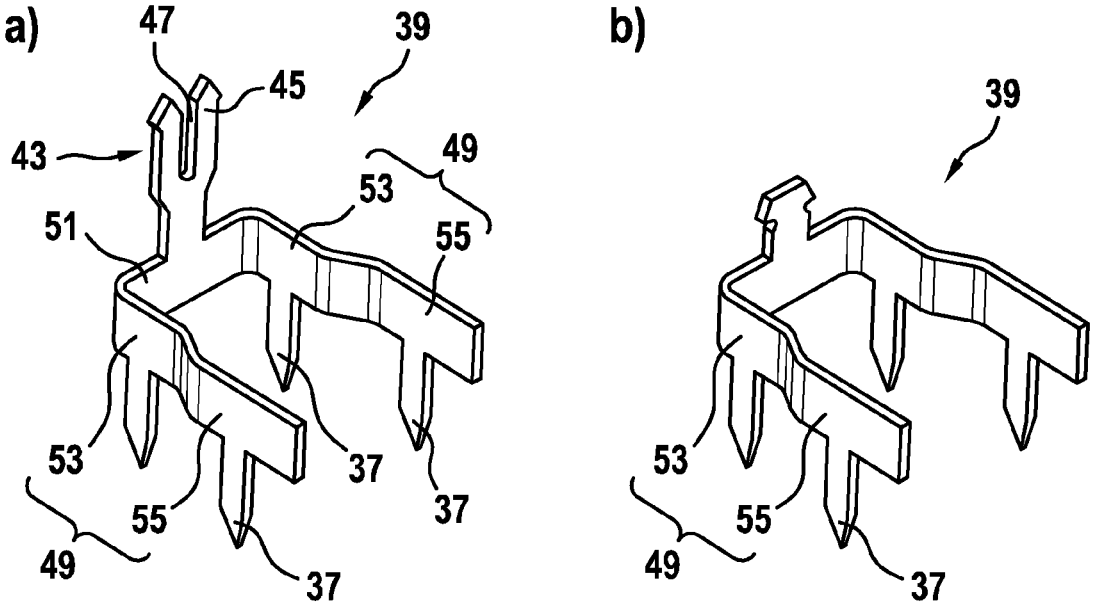
FIGS. 7(*a*) and (*b*) each show a perspective view of contact elements of a connection element according to the alternative embodiment of the present invention from FIG. 6.
Figure 8:
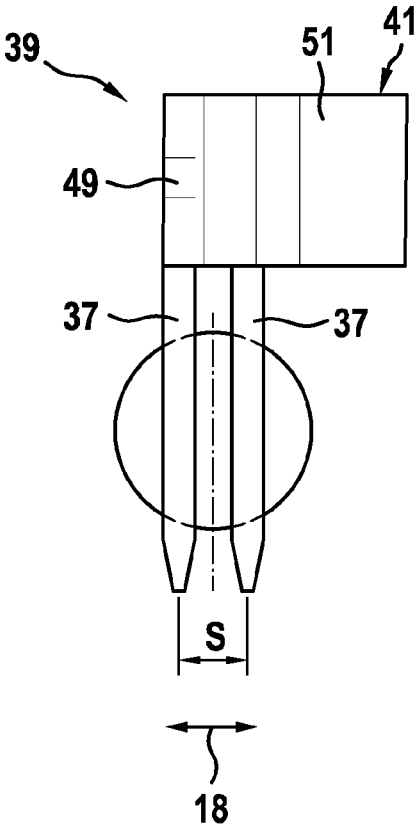
FIG. 8 shows a front view of one of the contact elements from FIGS. 7(*a*) and (*b*).

As shown in FIG. 7 in a perspective view and in FIG. 8 in a detailed view from the front, however, the two legs 49 do not run continuously in a straight line in this case. Instead, each leg 49 has a curvature, in particular an S-shaped curvature, approximately in its center, so that a first straight leg part 53 and a second straight leg part 55 run along lines which are parallel but offset from one another.

The entire leg 49 is received in the upper part 9 of the frame 7 such that it extends in a plane parallel to the inner surface 33 of the upper part 9 directed towards the interior 23. A piercing tip 37 protrudes from each of the leg parts 53, 55 transversely downwards, that is, into the interior 23. Due to the parallel offset of the leg parts 53, 55 relative to one another, the two piercing tips 37 arranged on one leg 49 in the longitudinal direction one behind the other and at a distance from one another are offset by an offset S from one another in a transverse direction relative to the longitudinal direction, i.e. parallel to the arrangement direction 18. The offset S can be of a similar magnitude as, for example, manufacturing-related positioning tolerances of the tension members 17 within the belt 5. Typically, such positioning tolerances can range from 0.3 mm to 0.7 mm.

Due to the staggered piercing tips 37 on one and the same leg 49 of a contact element 39, it can be ensured that, in the assembled state of the connection element 3, at least one of these piercing tips 37 mechanically and electrically contacts an associated tension member 17 of the belt 5 in the desired manner.

Figure 9:
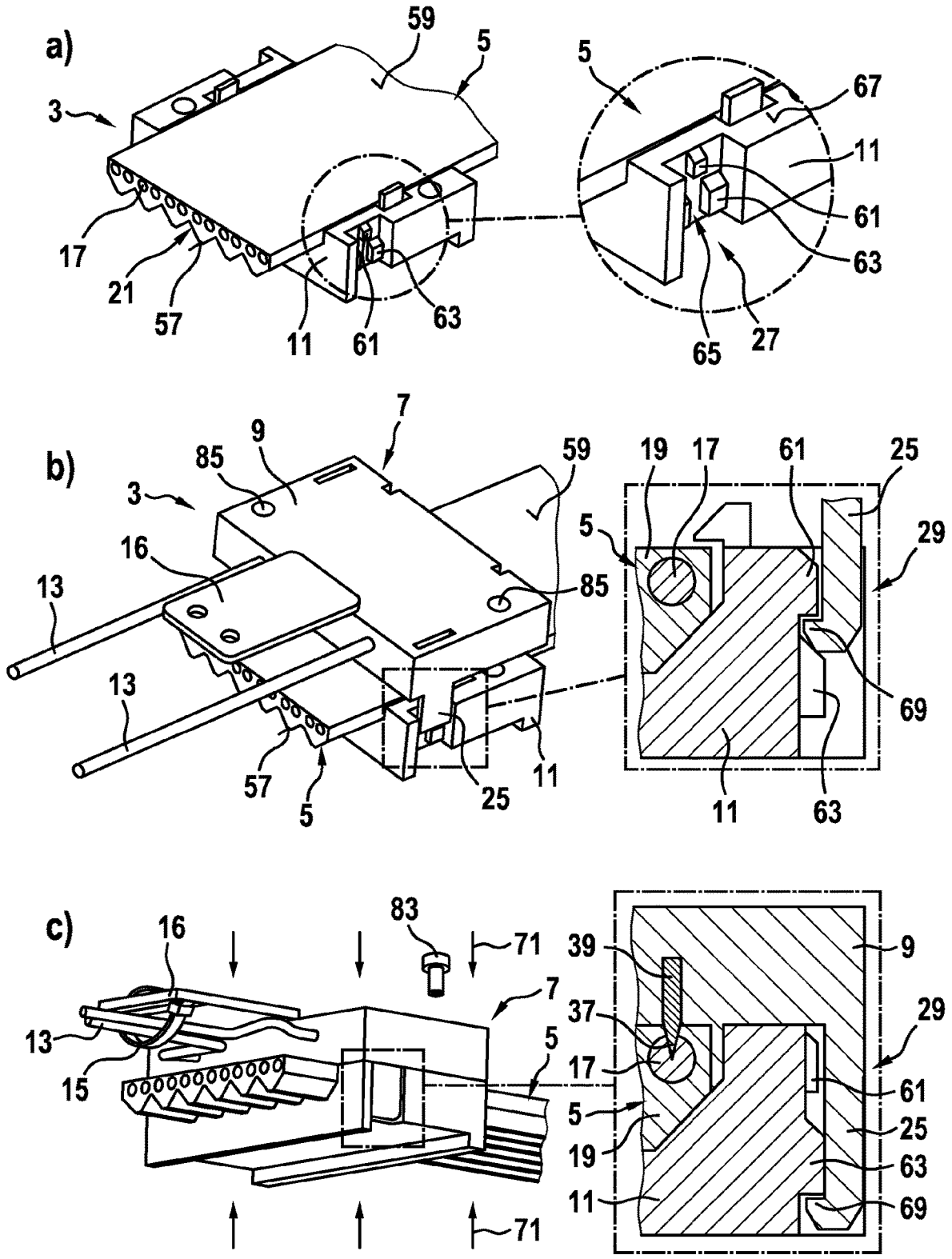
FIG. 9(*a*) to (*c*) illustrate steps of a method for assembling a connection element according to an embodiment of the present invention.

With reference to FIG. 9(*a*) to (*c*), details regarding an inventive method for assembling a connection element 3 on a belt 5 will now be described.

As shown in FIG. 9(*a*), the lower part 11 of the frame 7 is first applied to a surface 57 of the belt 5 which is directed downward in the figure. The lower part 11 has on its surface facing the belt 5 a contour that is essentially complementary to the profile 21 of the belt 5. The downward surface 57 of the belt 5 can thus lie largely flat on the upward surface of the lower part 11.

FIG. 9(*a*) shows the locking counterpart 27 of the double locking element 29. In this case, two pins 61, 63 are formed in a depression 65 on the lateral edge of the lower part 11 at different distances from an upwardly directed surface 67 of the lower part 11 in this edge region.

Then, as shown in FIG. 9(*b*), the upper part 9 is placed on a surface 59 of the belt 5 which is directed upward in the figure. A surface of the upper part 9 directed towards the belt 5 is flat, as is the opposite surface 59 of the belt 5, so that the upper part 9 can lie essentially flatly against the belt 5.

However, regions of the contact elements 39 received therein, that is to say in particular their piercing tips 37, protrude from the upper part 9 in the direction of the upwardly directed surface 59 of the belt 5. In this preassembled state, therefore, only the tips of these protruding regions of the contact elements 39 initially rest on the surface 59 of the belt 5, whereas the surface of the upper part 9 still remains at a distance from the surface 59 of the belt 5.

In order to be able to fix the frame 7 to the belt 5 in this preassembled state at least temporarily, a locking tab 25 directed towards the lower part 11 is provided on the lateral edges of the upper part 9 (see enlarged partial view from FIG. 9(*b*)). With a lateral projection 69, this locking tab 25 engages behind the first pin 61 protruding laterally on the lower part 11, such that the upper part 9 is held on the lower part 11 in a first locking position, i.e. in a pre-locking state, using the double locking element 29.

It is pointed out that, in principle, the upper part 9 can also first be arranged on the belt 5 and only then can the lower part 11 be arranged on an opposite side of the belt 5 and, if necessary, can be pre-locked with the upper part 9.

After the upper part 9 and the lower part 11 have been arranged in the preassembled state on opposite sides of the belt 5, the upper part 9 and the lower part 11 are then pressed against one another with a considerable force in the range from a few hundred Newtons to several Kilonewtons. This is shown in FIG. 9(*c*) by means of arrows 71 illustrating the compressive force.

Due to this application of force, the piercing tips 37 of the contact elements 39 protruding from the upper part 9 are pressed into the matrix material 19 of the belt 5 and ultimately into one of the tension members 17 in the belt 5.

Simultaneously with the pressing of the piercing tips 37 into the belt 5, the locking tab 25 of the upper part 9 is pushed further downward towards the lower part 11 until it engages behind the second pin 63 with the projection 69 thereof, said second pin protruding laterally on the lower part 11. After being pressed together, the upper part 9 is thus finally assembled on the lower part 11 by means of the double locking elements 29 in a second locking position, that is to say in an end-locking state.

In order to additionally secure the upper part 9 and the lower part 11 to one another, one or more screwing elements 83 (shown only schematically in FIG. 9(*c*)) can additionally be provided on the frame 7. The screwing elements 83 can be designed as screws, optionally supplemented with washers or bearing plates, which for example extend through through holes 85 in the upper part 9 and/or the lower part 11 and screw them together.

Figure 10:
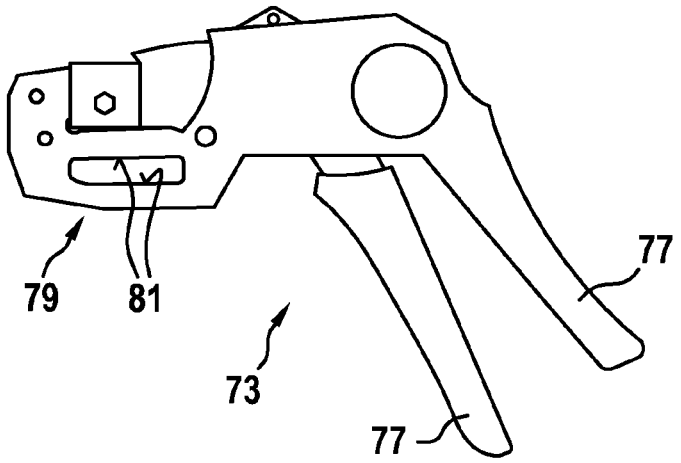
FIGS. 10(*a*) and (*b*) show examples of parallel pliers for use during a method of assembling a connection element according to an embodiment of the present invention.
Figure 10:
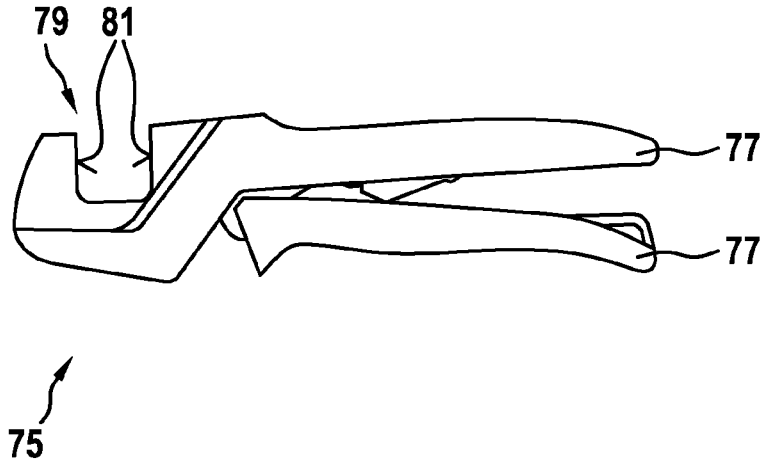

In order to be able to keep the upper part 9 and the lower part 11 of the frame 7 as parallel as possible to one another during said pressing together, the pressing together can be carried out using parallel pliers 73, 75, as shown in FIGS. 10(*a*) and (*b*) by way of example. Such parallel pliers 73, 75 can be actuated by manual displacement of levers 77, whereupon a jaw mechanism 79 presses two pressing surfaces 81 running parallel to one another while remaining parallel to one another.

Figure 11:
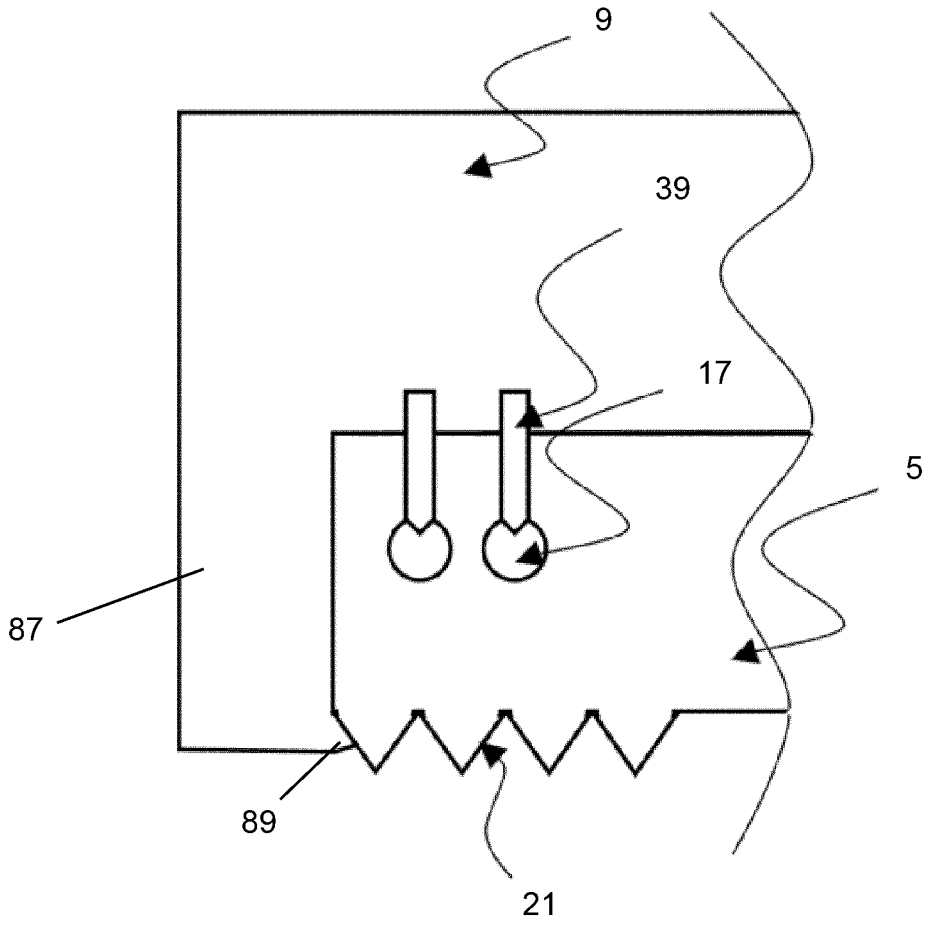
FIG. 11 shows an exemplary embodiment of the simplified embodiment of the connection element in a cross-sectional view.

FIG. 11 shows an exemplary embodiment of a simplified embodiment of the connection element having an upper part 9 in cross section. A lower part is missing in this embodiment. In this exemplary embodiment, the upper part 9 has securing means in the form of a clip 87 having an inwardly extending projection 89 which partially engages from behind, i.e. below the belt 5. This fixes the belt 5 on the upper part 9.

Finally, it should be noted that terms such as "having," "comprising," etc. do not preclude other elements or steps and terms such as "a" or "an" do not preclude a plurality. Furthermore, it should be noted that features or steps that have been described with reference to one of the above embodiments can also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A connection element for electrically contacting tension members embedded in a matrix material of a load-bearing belt for an elevator system, the connection element comprising:

a frame having an upper part and multiple electrically conductive contact elements;

wherein the frame is shaped to receive the belt in an interior space delimited by the frame at at least two opposite sides;

wherein the contact elements are formed as stamped and bent metal parts; and wherein some regions of the contact elements are arranged in the upper part of the frame and other regions of the contact elements protrude from the upper part into the interior space;

wherein at least one of the contact elements has a central region and at least one piercing tip protruding away from the central region into the interior space and being adapted to penetrate into the matrix material of the belt; and wherein the central region has at least one leg that extends parallel to a surface of the upper part facing the interior space of the frame, and wherein two of the at least one piercing tip protrude into the interior space from the leg, wherein the piercing tips are spaced apart from one another in a longitudinal direction of the belt when the belt is received by the connection element and the piercing tips are offset from one another in a direction transverse to the longitudinal direction by between 0.1 mm and a range of 40% to 70% of a diameter of the tension members in the belt.

2. The connection element according to claim 1 wherein the central region has two legs running parallel to one another, and wherein at least one of the at least one piercing tip protrudes from each of the legs into the interior space.

3. The connection element according to claim 1 wherein the at least one contact element has a connection region for connecting to an electrical line.

4. The connection element according to claim 3 wherein the connection region protrudes from the central region in a direction opposite to the at least one piercing tip.

5. The connection element according to claim 3 wherein the connection region is provided with an insulation displacement terminal.

6. The connection element according to claim 3 including an electrical line having one end connected to the connection region and another end that extends out of the frame for external contacting.

7. The connection element according to claim 1 wherein the contact elements are formed from a stainless steel material.

8. The connection element according to claim 1 wherein the frame includes a lower part and wherein the frame has locking elements for interlocking the upper part and the lower part together.

9. The connection element according to claim 8 wherein the locking elements are double locking elements that engage the upper part and the lower part in a pre-locking state having a first locking position at a distance from the belt received in the interior space and engage the upper part and the lower part in an end-locking state having a second locking position abutting against opposite surfaces of the belt received in the interior space.

10. The connection element according to claim 8 wherein the frame has screw elements adapted to screw the upper part and the lower part together.

11. A belt arrangement for an elevator system comprising:

a load-bearing belt having a plurality of electrically conductive tension members embedded in an electrically insulating matrix material, the tension members being spaced apart from one another in an arrangement direction;

a connection element according to claim 1; and wherein the belt is arranged in the interior space of the frame of the connection element and each of contact elements of the connection element protrudes into the interior space and contacts one of the tension members of the belt.

12. A method for assembling a connection element according to claim 1 on a load-bearing belt for an elevator system, the method comprising the steps of:

arranging the upper part of the frame of the connection element on a first surface of the belt;

arranging a counterpart to the upper part on a second surface of the belt opposite the first surface; and pressing the upper part and the counterpart towards each other such that the other regions of the contact elements protruding from the upper part into the interior space are pressed into the belt and contact the tension members embedded in the belt.

13. The method according to claim 12 wherein the counterpart is a lower part of the frame and comprising the steps of:

arranging the lower part on the second surface; and pressing the upper part and the lower part towards each other such that the other regions of the contact elements protruding from the upper part into the interior space are pressed into the belt and contact the embedded tension members.

14. The method according to claim 13 including pressing the upper part and the lower part together using a pair of pliers.

15. The method according to claim 14 wherein the pair of pliers is a pair of parallel pliers.

16. The method according to claim 12 wherein the counterpart is part of a pair of parallel pliers and the upper part is pressed into the belt upon actuation of the pliers.

17. A method for assembling a connection element on a load-bearing belt for an elevator system, the method comprising the steps of:

providing the connection element having a frame with an upper part and multiple electrically conductive contact elements, wherein the frame is shaped to receive the belt in an interior space delimited by the frame at at least two opposite sides, wherein the contact elements are formed as stamped and bent metal parts, and wherein some regions of the contact elements are arranged in the upper part of the frame and other regions of the contact elements protrude from the upper part into the interior space;

arranging the upper part of the frame of the connection element on a first surface of the belt;

arranging a counterpart to the upper part on a second surface of the belt opposite the first surface, wherein the counterpart is a lower part of the frame;

pressing the upper part and the lower part towards each other such that the other regions of the contact elements protruding from the upper part into the interior space are pressed into the belt and contact the tension members embedded in the belt; and pressing the upper part and the lower part together using a pair of pliers.

18. The method according to claim 17 wherein the pair of pliers is a pair of parallel pliers or wherein the counterpart is part of a pair of parallel pliers and the upper part is pressed into the belt upon actuation of the pliers.

* * * * *